US005768771A

United States Patent [19]

O'Sullivan et al.

[11] Patent Number: 5,768,771

[45] Date of Patent: Jun. 23, 1998

[54] SYSTEM FOR TERMINATING THE SHIELD OF A HIGH SPEED CABLE

[75] Inventors: Michael O'Sullivan, Willowbrook; Daniel L. Dawiedczyk, Lisle; Joseph W. Nelligan, Jr., LaGrange Park, all of Ill.

[73] Assignee: Molex Incorporated, Lisle, Ill.

[21] Appl. No.: 609,578

[22] Filed: Mar. 1, 1996

[51] Int. Cl.[6] ..... H01B 13/20

[52] U.S. Cl. ..... 29/828; 439/579; 29/860; 29/857

[58] Field of Search ..... 29/828, 860, 867, 29/863, 857; 439/579, 497, 880, 877, 98; 174/84 R, 84 C, 88 C, 89, 94 R

[56] References Cited

U.S. PATENT DOCUMENTS 4,602,832 7/1986 Cunningham et al. .

5,473,117 12/1995 Morgan et al. ..... 29/860

5,575,667 11/1996 Mehez et al. ..... 439/579

*Primary Examiner*—Carl E. Hall

*Assistant Examiner*—Christopher Goins

*Attorney, Agent, or Firm*—Charles S. Cohen

[57] ABSTRACT

A method is disclosed for terminating the metallic shield of a high speed cable. The method includes the steps of providing a cable with an exposed portion of the metallic shield of the cable and a conductive terminating member having a plurality of positioning arms. Each arm is formable from an open position to a closed position. The metallic shields are soldered to a positioning arm while the arm is in its open position. Each arm is formed to its closed position to properly position the high speed cables.

12 Claims, 4 Drawing Sheets

SYSTEM FOR TERMINATING THE SHIELD OF A HIGH SPEED CABLE

FIELD OF THE INVENTION

This invention generally relates to the art of electrical connectors and, particularly, to a system for terminating the metallic shield of a high speed cable, such as the metallic braid of the cable.

BACKGROUND OF THE INVENTION

A typical high speed cable includes a center conductor or core surrounded by a tube-like inner dielectric. A shield is disposed outside the inner dielectric for shielding and/or grounding the cable. The shield typically is a tubular metallic braid. However, one or more longitudinal conductive wires have also been used and are commonly called "drain wires." An insulating jacket surrounds the composite cable outside the shield.

Various types of connectors are used to terminate high speed cables. The connectors typically have contacts which are terminated to the center conductor or core of the cable. The connectors also have one form or another of a terminating member for terminating the metallic shield of the high speed cable, usually for grounding purposes. A typical system in such connectors terminates the metallic shield to the terminating member by soldering. Other systems use crimping procedures to crimp at least a portion of the terminating member securely to the metallic braid for commoning purposes.

With the ever-increasing miniaturization of the electronics in various industries, such as in the computer and telecommunications industries, along with the accompanying miniaturization of electrical connectors, considerable problems have been encountered in terminating miniature high speed cables, particularly in terminating the metallic shield of the cable. For instance, the outside diameter of a small coaxial cable may be on the order of 0.090 inch. The outside diameter of the inner dielectric surrounding the conductor/core may be on the order of 0.051 inch, and the diameter of the center conductor/core may be on the order 0.012 inch. Coaxial cables having even smaller dimensional parameters have been used.

The problems in terminating such very small coaxial cables often revolve around terminating the metallic shield of the cable. For instance, if soldering methods are used, applying heat (necessary for soldering) in direct proximity to the metallic shield can cause heat damage to the underlying inner dielectric and, in fact, substantially disintegrate or degrade the inner dielectric. If conventional crimp-type terminations are used, typical crimping forces often will crush or deform the inner dielectric surrounding the center conductor/core of the cable.

The above problems are further complicated when the metallic shield of the high speed cable is not terminated to a cylindrical terminating member, but the shield is terminated to a flat terminating member or contact. For instance, it is known to terminate the tubular metallic shield or braid of a coaxial cable to a flat ground circuit pad on a printed circuit board. This is accomplished most often by simply gathering the tubular metallic braid of the coaxial cable into a twisted strand or "pigtail" which, in turn, is soldered to the flat ground pad on the circuit board.

Another example of terminating the metallic shield or braid of a coaxial cable to a flat ground member is shown in U.S. Pat. No. 5,304,069, dated Apr. 19, 1994 and assigned to the assignee of the present invention. In that patent, the metallic braids of a plurality of coaxial cables are terminated to a ground plate of a high speed signal transmission terminal module. The conductors/cores of the coaxial cables are terminated to signal terminals of the module.

In terminating the tubular metallic shields or braids of high speed cables to flat ground contact pads as in a printed circuit board, or to a planar ground plate as in the above-referenced U.S. patent, or to any other flat or non-tubular terminating member, various design considerations should be considered as has been found with the present invention. It should be understood that there is a transition zone created where the center conductor/core of the high speed cable goes from a "controlled environment"wherein the conductor/core is completely surrounded by the tubular metallic shield or braid, to an "uncontrolled environment" where the braid is spread away from the conductor/core for termination to the non-tubular terminating member. It is desirable that this transition zone be held to as small an area as possible and as short a length (i.e., longitudinally of the cable) as possible. Preferably, the metallic shield or braid should be terminated over an area (or at least at two points) approximately 180° apart in relation to the center conductor/core of the cable. Preferably, the flat terminating member should overlap or at least extend to the point where the metallic shield or braid is separated from its tubular configuration surrounding the conductor/core of the cable. Still further, it is desirable that the metallic shield or braid of any given high speed cable be terminated on the same side of the flat terminating member as the center conductor/core of the cable.

The present invention is directed to solving the above-identified problems and satisfying as many of the above-identified design parameters as possible in an improved system for terminating the metallic shield of a high speed cable to a terminating member, such as a ground plate.

SUMMARY OF THE INVENTION

An object, therefore, of the invention is to provide a new and improved method of terminating the metallic shield of a coaxial cable, as well as a terminating member for the shield of the cable.

In the exemplary embodiment of the invention, the method includes providing an exposed portion of the metallic shield of a high speed cable and a conductive terminating member with a plurality of positioning arms formable from an open position to a closed position. The metallic shields are soldered to the positioning arms while the arms are in their open positions. The arms then are formed to their closed positions to properly position the high speed cable.

Preferably, the metallic shield is spread away from the inner dielectric of the cable prior to the soldering step. This further ensures that the heat from the soldering process does not damage the dielectric.

As disclosed herein, the conductive terminating member is formed with a blade portion having a pair of the opposed positioning arms at opposite edges of the blade portion for positioning a pair of coaxial cables therebetween. A pair of the opposed positioning arms provided on each opposite side of the blade portion. The blade portion is generally planar with the positioning arms being generally coplanar therewith when in the open positions of the arms. After soldering, the arms are formable to their closed positions generally perpendicular to the planar blade portion to define channels within which the coaxial cables finally are positioned.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
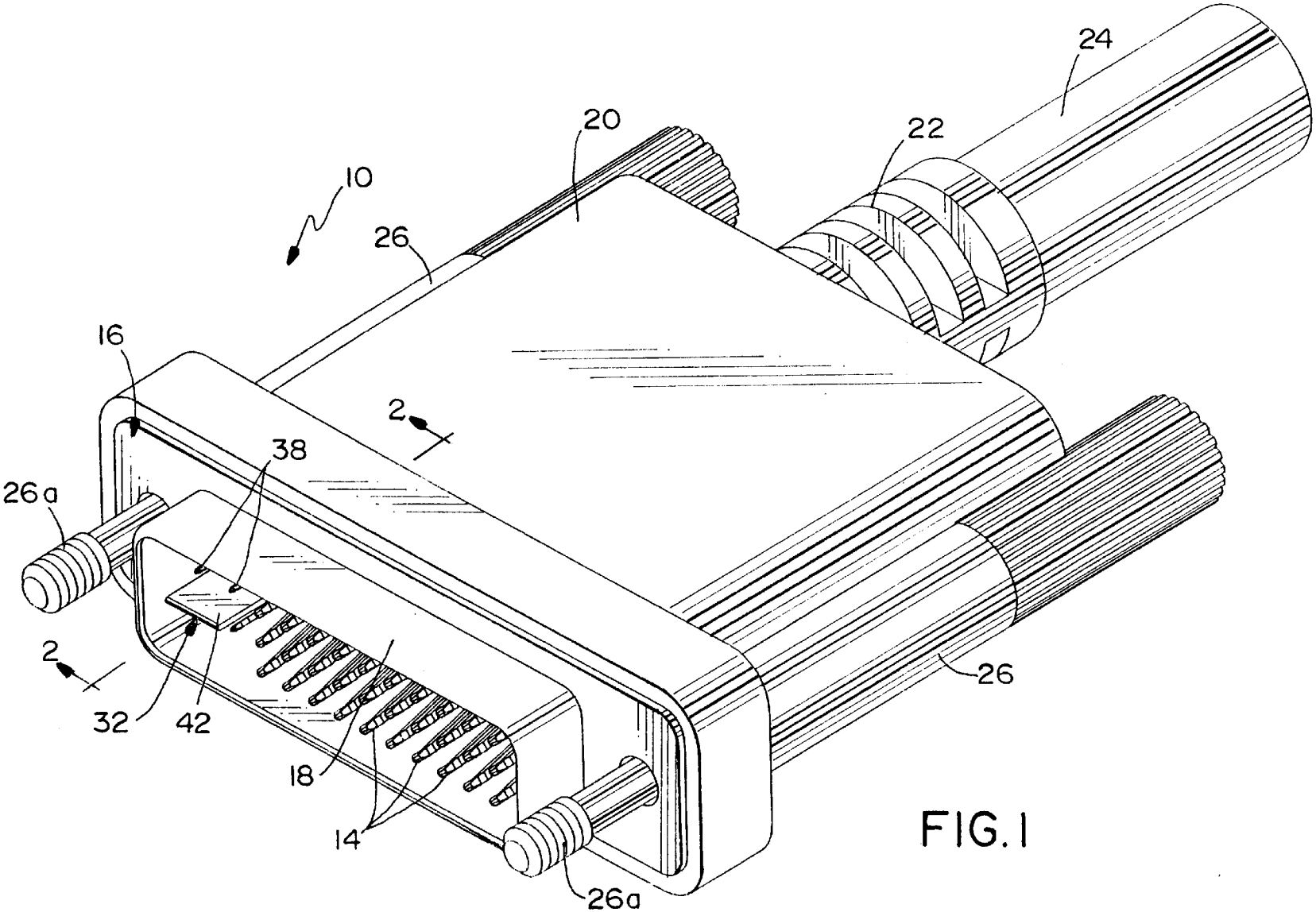
FIG. 1 is a perspective view of an electrical connector of a type in which the invention is applicable.
Figure 2:
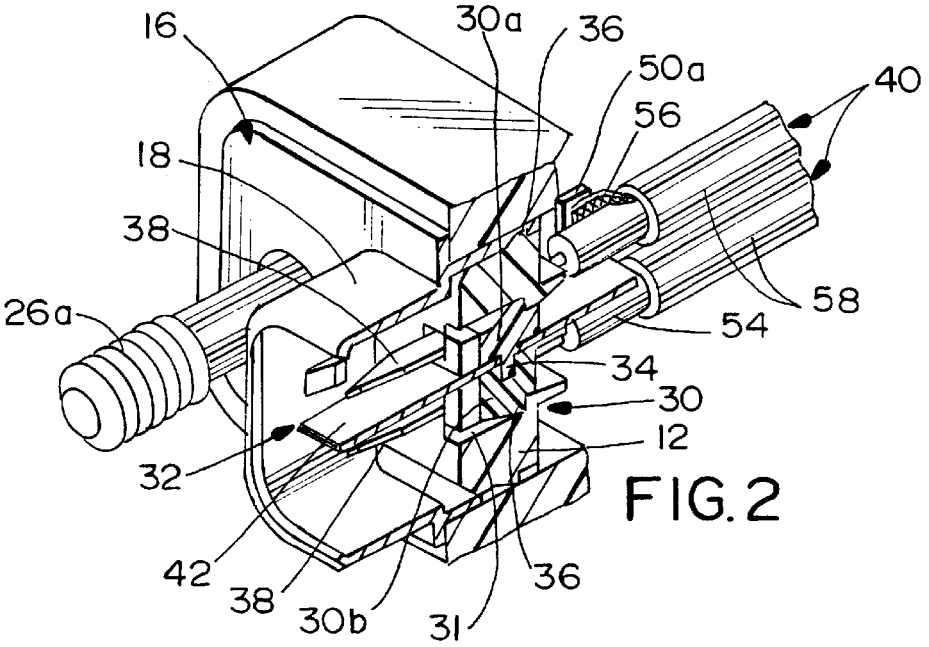
FIG. 2 is a fragmented vertical section taken generally along line 2—2 of FIG. 1.

Referring to the drawings in greater detail, and first to FIGS. 1 and 2, the invention is embodied in a shielded electrical connector, generally designated 10, which is a hybrid electrical connector for terminating both the conductors of slower data transmission lines and the conductors of high speed or high frequency transmission lines. In particular, electrical connector 10 includes a dielectric housing 12 (FIG. 2) mounting a plurality of data transmission terminals 14 (FIG. 1). A conductive shield, generally designated 16, substantially surrounds dielectric housing 12 and has a shroud portion 18 projecting forwardly about the mating ends of data transmission terminals 14. A two-piece backshell (not shown substantially in conformance with that shown in U.S. Pat. No. 5,358,428, dated Oct. 25, 1994) projects rearwardly of housing 12 and shield 16. An overmolded boot 20 includes an integral cable strain-relief 22 that is in engagement with a composite electrical cable 24 which includes both the data transmission lines and the high speed or high frequency transmission lines. A pair of thumb screws 26 project through the overmolded boot and include externally threaded forward distal ends 26*a* for securing the connector to a complementary mating connector, panel or other structure.

As seen best in FIG. 2, a high speed signal transmission terminal module, generally designated 30, is inserted into a passage 31 in dielectric housing 12 from the rear thereof. The terminal module includes a pair of identical terminal blocks 30*a* and 30*b* which clamp a ground plate, generally designated 32, therebetween. Each terminal block includes a post 34 and a recess. The post from each terminal block extends from each terminal block through a hole or slot 44 (FIG. 3) in the ground plate and into a recess in the other terminal block to secure terminal blocks 30*a* and 30*b* to ground plate 32 as a subassembly. Once this subassembly is inserted into passage 31 in housing 12 as shown in FIG. 2, the terminal blocks are effective to clamp the ground plate therebetween. The terminal module is held within the dielectric housing by ramped latches 36, on each terminal block.

Each terminal block 30*a* and 30*b* is overmolded about at least one high speed signal terminal 38. The contact ends of a pair of the terminals 38, along with the forward end of ground plate 32, are shown projecting forwardly of the connector in FIG. 1, within the surrounding shroud portion 18 of shield 16. The rear ends 38*a* of terminals 38 are terminated to the center conductor/cores 52 of a plurality of coaxial cables, generally designated 40 in FIG. 2. The invention is particularly directed to the manner of termination of the metallic shields 56 of the coaxial cables to ground plate 32, as described below.

Figure 3:
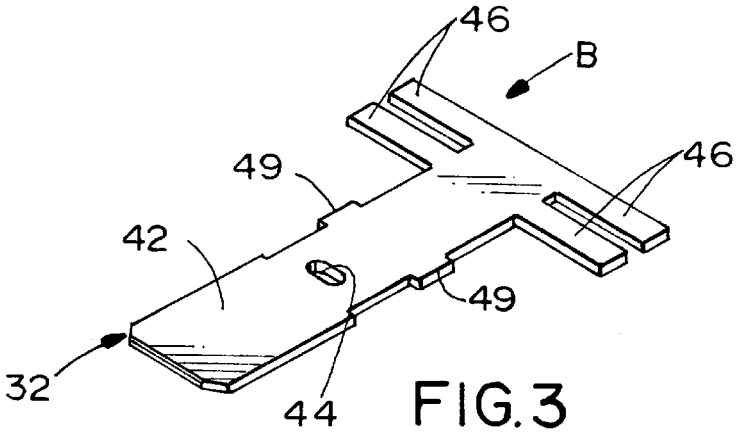
FIG. 3 ,is a perspective view of a stamped metal blank from which the terminating member or ground plate is formed.

More particularly, FIG. 3 shows a blank, generally designated "B," stamped from conductive sheet metal material and from which ground plate 32 is formed. Blank "B" is generally T-shaped and includes a leg or stem portion 42 which will form a blade portion for ground plate 32. The blade portion includes an aperture 44 through which posts 34 (FIG. 2) of terminal blocks 30*a* and 30*b* extend. A pair of wings or arms 46 project outwardly at one end of leg 42 generally at each opposite edge thereof. These wings will form the positioning arms of the ground plate, as will be seen hereinafter. Lastly, barbs or teeth 49 are stamped at the opposite edges of blade portion 42 to facilitate holding the subassembly of the ground plate and terminal blocks 30*a* and 30*b* within the housing.

Figure 4:
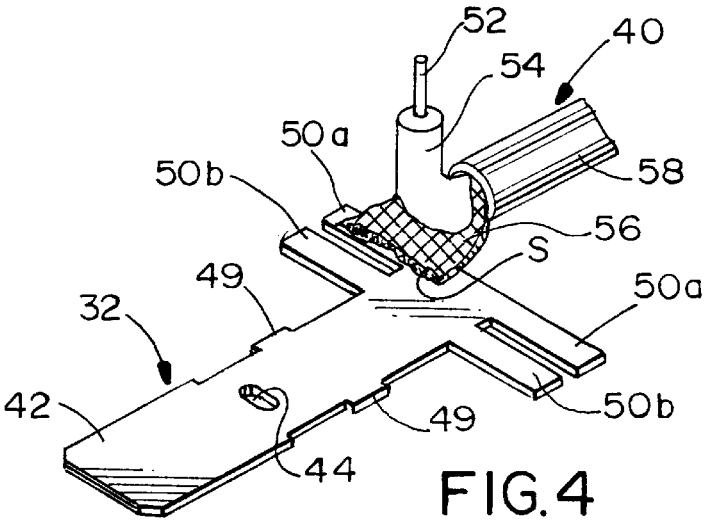
FIG. 4 is a perspective view of the ground plate with the positioning arms in their open position, and with the metallic shield of one of the coaxial cables being soldering to one of the arms.

Reference now is made to FIG. 4 wherein wings 46 of blank "B" in FIG. 3 now will be referred to as two pairs of positioning arms 50*a* and 50*b*. The pair of positioning arms 50*a* are at the extreme end of ground plate 32 opposite blade portion 42. The pair of positioning arms 50*b* are located slightly forward of arms 50*a* . If desired, the arms 50*a* and 50*b* could be spaced inwardly from the end of ground plate 32 so that the ground plate extends along cable 40 at the point where the metallic shield 56 of the cable is separated from the inner dielectric layer 54.

In essence, ground plate 32 is provided with a pair of opposed positioning arms 50*a* at opposite edges of the plate for positioning a pair of coaxial cables, as well as providing a pair of the opposed positioning arms 50*a* and 50*b* on each opposite side of the plate. One pair 50*a* is located at the extreme rear distal end of blade portion 42, and the other pair 50*b* is located slightly spaced longitudinally forward of the first pair. With this structure, the ground plate can terminate from one to four coaxial cables depending on the specifications of the connector. In some computer applications, three cables may be used to carry the red, green and blue chroma signals for a monitor. A fourth cable might be used for flat screen monitors for carrying the pixel clock timing signals.

FIG. 4 also shows that each of the coaxial cables 40 typically includes a center conductor or core 52 surrounded by a tube-like inner dielectric 54. A metallic shield in the form of a tubular metallic braid 56 surrounds inner dielectric 54. An insulating jacket 58, as of plastic or the like, surrounds metallic braid 56 to form the overall composite coaxial cable 40. It can be seen that center conductor/core 52 of coaxial cable 40 has been stripped to expose a given length thereof which is soldered to the inner end 38*a* (FIG. 9) of one of the high speed signal transmission terminals 38 (FIG. 2). The outer insulating jacket 58 of the cable also has been cut-back to expose a given length of the metallic shield 56. Therefore, the exposed shield can be soldered to one of the gripping arms 50*a* or 50*b* of ground plate 32.

Still referring to FIG. 4, after ground plate 32 has been stamped from a stock of sheet metal material, the metallic shield 56 of one of the coaxial cables 40 is pulled away or spread from dielectric 54 and placed on top of one of the end-most positioning arms 50*a* as seen in FIG. 4. Since the metallic shield of the coaxial cable shown herein comprises a metallic braid, the braid is spread across the one positioning arm 50*a* , preferably from the distal end or tip of the arm to approximately the center of the blade portion 42 of ground plate 32. Dielectric 54 and conductor/core 52 also can be bent upwardly as shown in FIG. 4 to further separate the metallic braid from the inner dielectric. The dielectric then is soldered to the one positioning arm, as at "S." It should be understood that by separating the metallic braid from the inner dielectric, as shown, the heat required for the soldering process can be isolated from the inner dielectric to prevent any damage thereto.

Figure 5:
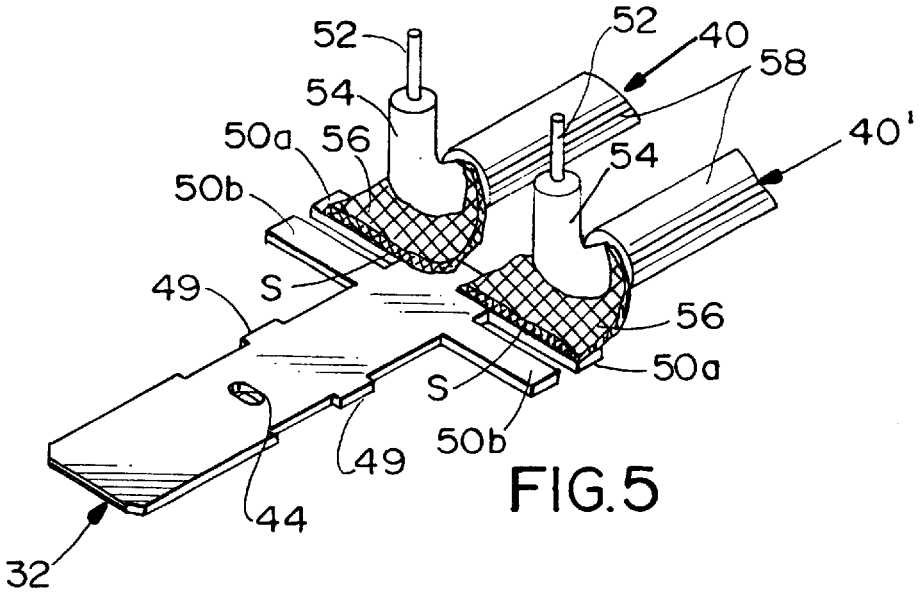
FIG. 5 is a view similar to that of FIG. 4, but showing a second coaxial cable having the metallic shield thereof being soldered to a second positioning arm on the same side of the terminating member.

FIG. 5 shows the next step in the process, wherein the metallic braid 56 of a second coaxial cable 40' is soldered to the other end-most positioning arm 50*a*. Again, the inner dielectric is bent upwardly, and the metallic shield is spread over the arm prior to soldering.

Figure 6:
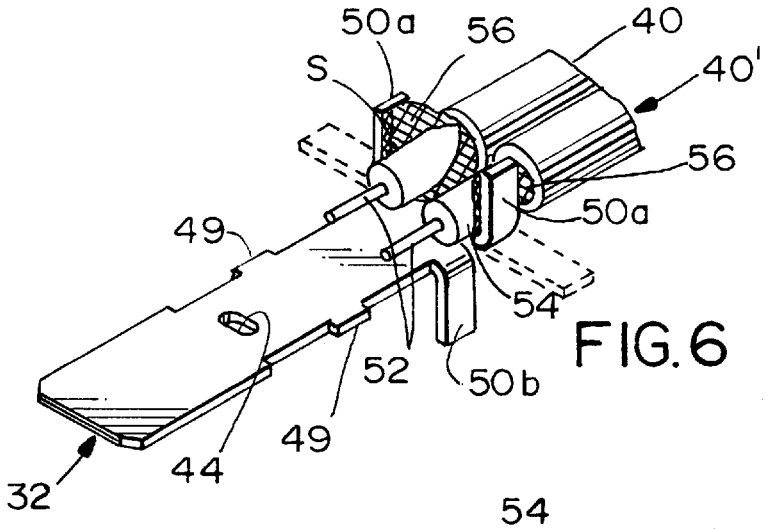
FIG. 6 is a view similar to that of FIG. 5, but showing the two positioning arms being bent to their closed positions moving the terminated coaxial cables therewith.

After metallic shields 56 of coaxial cables 40 and 40' are soldered to positioning arms 50*a* as shown in FIG. 5, inner dielectric members 45 are straightened back to their original linear configuration and the positioning arms are bent upwardly as seen in FIG. 6 relative to blade portion 42 of ground plate 32. Preferably, the positioning arms are bent generally perpendicular to the blade portion to form a generally U-shaped channel for positioning the coaxial cables therebetween as seen in FIG. 6. Arms 50 are preferably slightly longer than the diameter of inner dielectric 54. The width of blade portion 42 at the rear thereof is at least as large as twice the diameter of inner dielectric 54. Therefore, two cables may be positioned on each side of blade portion 42. In this configuration, the shield of each coaxial cable extends circumferentially approximately 180° about the center conductor/core of the cable. In other words, a line extending between opposite ends of the soldered metallic braid will also pass approximately through center conductor 52.

Figure 7:
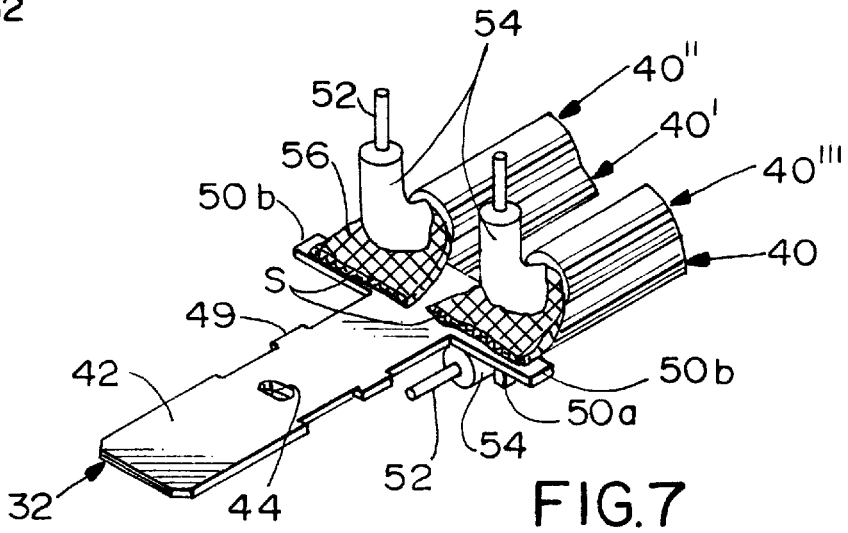
FIG. 7 is a view similar to FIG. 5, but showing the terminating member flipped over for soldering the metallic shields of two additional coaxial cables to the remaining two positioning arms on the opposite side of the terminating member.

The next step in the process is to repeat the steps of FIGS. 4 and 5 for two additional coaxial cables 40" and 40'" with respect to the other two positioning arms 50*b* as seen in FIG. 7. In particular, ground plate 32 and the terminated coaxial cables 40 and 40' are turned over, the inner dielectric 54 of each coaxial cable 40" and 40'" is bent upwardly, and metallic shields 56 of coaxial cable 40"and 40'" is soldered to positioning arms 50*b* as clearly shown in FIG. 7.

Figure 8:
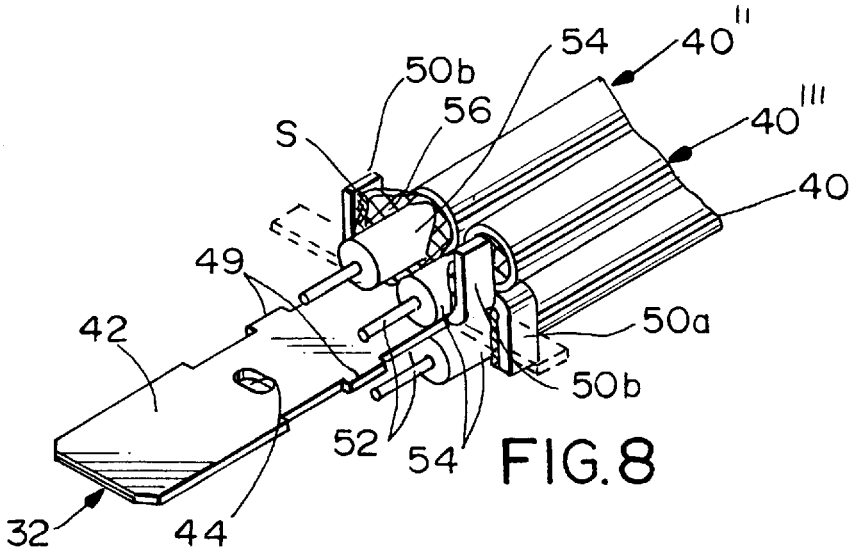
FIG. 8 is a view similar to that of FIG. 7, but with the remaining two positioning arms bent upwardly of the terminating member.

After the metallic shields of coaxial cables 40"and 40'" are soldered to positioning arms 50*b*, the inner dielectric members are straightened back to their original linear configurations, and the positioning arms are bent generally perpendicular to blade portion 42 of ground plate 32 as shown in FIG. 8. Like positioning arms 50*a*, positioning arms 50*b* form a generally U-shaped channel 42 to position coaxial cables 40" and 40'" therewithin. Preferably, blade portion 42 extends rearwardly beyond, or at least overlaps, the point where the metallic shields discontinue their cylindrical configurations inside jackets 58 and start to become spread out over arms 50*a* and 50*b*.

Figure 9:
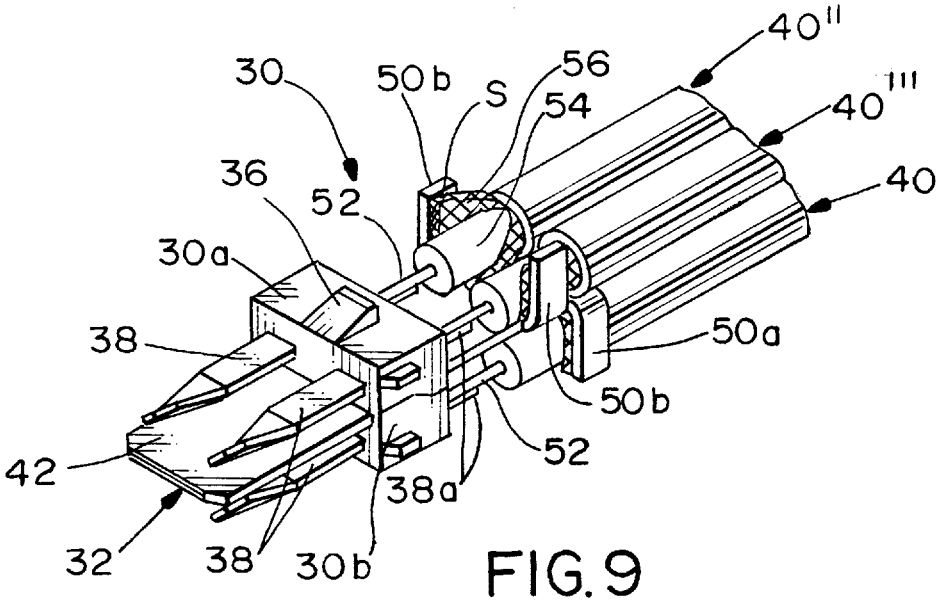
FIG. 9 is a perspective view of the terminal module of the connector, including the subassembly of FIG. 8.

Once the subassembly of FIG. 8 is fabricated, including the soldering procedures, this subassembly is assembled to terminal blocks 30*a* and 30*b* and high speed signal transmission terminals 38 to form terminal module 30 as shown in FIG. 9 and described above in relation to FIG. 2. Center conductors/cores 52 of the coaxial cables are connected, as by soldering, welding or otherwise securing to the inner ends 38*a* of terminals 38 (FIG. 9), with terminal blocks 30*a* and 30*b* clamping blade portion 42 of ground plate 32 therebetween, as shown in FIG. 2 and described above. The terminal module then is mounted within dielectric housing 12 as shown in FIG. 2.

The concepts of the invention have been shown and described herein in conjunction with terminating the metallic shield of the coaxial cable to a terminating member 32 in the form of a ground plate 42. However, it should be understood that the concepts of the invention are equally applicable for terminating the metallic shield 56 to other types of terminating members, such as electrical terminals themselves.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A method of terminating a high speed cable, comprising the steps of:

providing a plurality of high speed cables, each cable having an inner conductor, an inner dielectric surrounding said inner conductor, a metallic ground shield at least partially surrounding said inner conductor, with a portion of said metallic ground shield exposed, and an outer dielectric sheath at least partially covering said metallic ground shield;

providing a conductive terminating member with a plurality of positioning arms formable from an open position to a closed position;

soldering the exposed portion of the metallic shield of each cable to a respective one of the positioning arms while the arm is in its open position; and forming each positioning arm to its closed position to properly position the coaxial cables relative to each other.

2. The method of claim 1 further including the step of spreading the metallic shield away from the inner dielectric prior to said soldering step.

3. The method of claim 1, wherein said conductive terminating member includes a generally planar blade portion having a pair of positioning arms extending at opposite edges of the blade portion, and said soldering step includes soldering said exposed portion of the metallic shields of two cables onto two of said positioning arms on a common face of the blade portion and then forming said positioning arms to their respective closed positions.

4. The method of claim 3, wherein said conductive terminating member includes a pair of said positioning arms extending at opposite edges of the blade portion and soldering said exposed portion of the metallic shields of a second two cables onto a second pair of said positioning arms on a second face of the blade portion, said second face being opposite said common face, and then forming said second pair of positioning arms to their respective closed positions.

5. The method of claim 1, wherein said conductive terminating member includes a generally planar blade portion having a pair of positioning arms extending at opposite edges of the blade portion and being generally coplanar therewith in the open position of the arms, and wherein the forming step includes forming said arms to a position generally perpendicular to the blade portion.

6. The method of claim 5, wherein said soldering step includes positioning a pair of said cables generally upon said blade portion and said forming step creates a channel shape with the pair of coaxial cables therewithin.

7. A method of terminating a high speed cable, comprising the steps of:

providing a plurality of high speed cables, each cable having an inner conductor, an inner dielectric surrounding said inner conductor, a metallic ground shield at least partially surrounding said inner conductor, with a portion of said metallic ground shield exposed, and an outer dielectric sheath at least partially covering said metallic ground shield;

providing a conductive terminating member with a blade portion having a pair of opposed positioning arms at opposite edges of the blade portion, each arm being formable from an open position to a closed position;

positioning the exposed portion of the metallic braids of the coaxial cables onto a respective one of the positioning arms over an area extending from near a distal end of the respective arm to near a longitudinal centerline of the blade portion;

soldering the metallic braids to the respective positioning arms while the arms are in their open positions; and forming the arms to closed positions to properly position the coaxial cables.

8. The method of claim 7 further including the step of spreading the metallic shield away from the inner dielectric prior to said soldering step.

9. The method of claim 7, wherein said conductive terminating member includes a generally planar blade portion having a pair of positioning arms extending at opposite edges of the blade portion, and said soldering step includes soldering said exposed portion of the metallic shields of two cables onto two of said positioning arms on a common face of the blade portion and then forming said positioning arms to their respective closed positions.

10. The method of claim 9, wherein said conductive terminating member includes a pair of said positioning arms extending at opposite edges of the blade portion and soldering said exposed portion of the metallic shields of a second two cables onto a second pair of said positioning arms on a second face of the blade portion, said second face being opposite said common face, and then forming said second pair of positioning arms to their respective closed positions.

11. The method of claim 7, wherein said conductive terminating member includes a generally planar blade portion having a pair of positioning arms extending at opposite edges of the blade portion and being generally coplanar therewith in the open position of the arms, and wherein the forming step includes forming said arms to a position generally perpendicular to the blade portion.

12. The method of claim 11, wherein said soldering step includes positioning a pair of said cables generally upon said blade portion and said forming step creates a channel shape with the pair of coaxial cables therewithin.

* * * * *